US011536529B2

(12) United States Patent
Pipart et al.

(10) Patent No.: US 11,536,529 B2
(45) Date of Patent: Dec. 27, 2022

(54) DEVICE FOR EXTRACTING A LARGE-CALIBER PROJECTILE JAMMED IN A WEAPON BARREL

(71) Applicant: NEXTER SYSTEMS, Versailles (FR)

(72) Inventors: Romain Pipart, Bourges (FR); Patrick Multon, Bourges (FR)

(73) Assignee: NEXTER SYSTEMS, Versailles (FR)

( * ) Notice: Subject to any disclaimer, the term of this patent is extended or adjusted under 35 U.S.C. 154(b) by 0 days.

(21) Appl. No.: 17/371,783

(22) Filed: Jul. 9, 2021

(65) Prior Publication Data

US 2022/0057157 A1 Feb. 24, 2022

(30) Foreign Application Priority Data

Jul. 23, 2020 (FR) ..... 2007567

(51) Int. Cl.
*F41A 15/22* (2006.01)

(52) U.S. Cl.
CPC ..... *F41A 15/22* (2013.01)

(58) Field of Classification Search
CPC ..... F41A 15/22
USPC ..... 42/90, 95
See application file for complete search history.

(56) References Cited

U.S. PATENT DOCUMENTS 3,731,587 A * 5/1973 Digiacomo ..... F41A 15/22 81/3.05
5,430,966 A * 7/1995 Hippensteel ..... F41A 15/22 42/90
10,337,814 B1 * 7/2019 Shaker ..... F41A 15/22

FOREIGN PATENT DOCUMENTS

FR 2975178 A1 11/2012

OTHER PUBLICATIONS

Jul. 23, 2020 Written Opinion issued in French Patent Application No. FR2007567.
Mar. 25, 2021 Search Report issued in French Patent Application No. FR2007567.

* cited by examiner

*Primary Examiner* — Bret Hayes
(74) *Attorney, Agent, or Firm* — Oliff PLC

(57) ABSTRACT

A device, and method for using the device, for extracting a large-caliber projectile jammed in a barrel of a weapon including a solid body having a diameter smaller than the caliber of the barrel and intended to be introduced into the barrel at the muzzle of the latter and then released in the barrel in order to impact, by inertia, the jammed projectile. The device is at least two radially expandable locking mechanisms, each able to move between a locked position in which it is applied radially against the inner wall of the barrel and a released position in which it is not applied against the barrel, the passage of the locking mechanisms from one position to the other by an expansion apparatus, the device includes a translation device enabling a first locking mechanism to be translated axially to a second locking mechanism.

9 Claims, 11 Drawing Sheets

[Fig. 1]
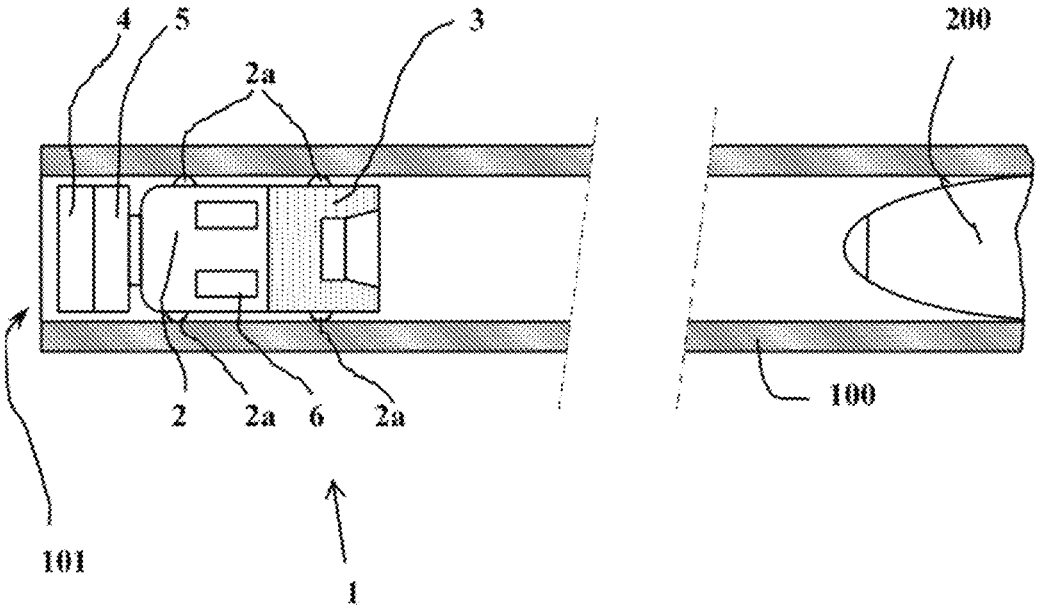

[Fig. 2]
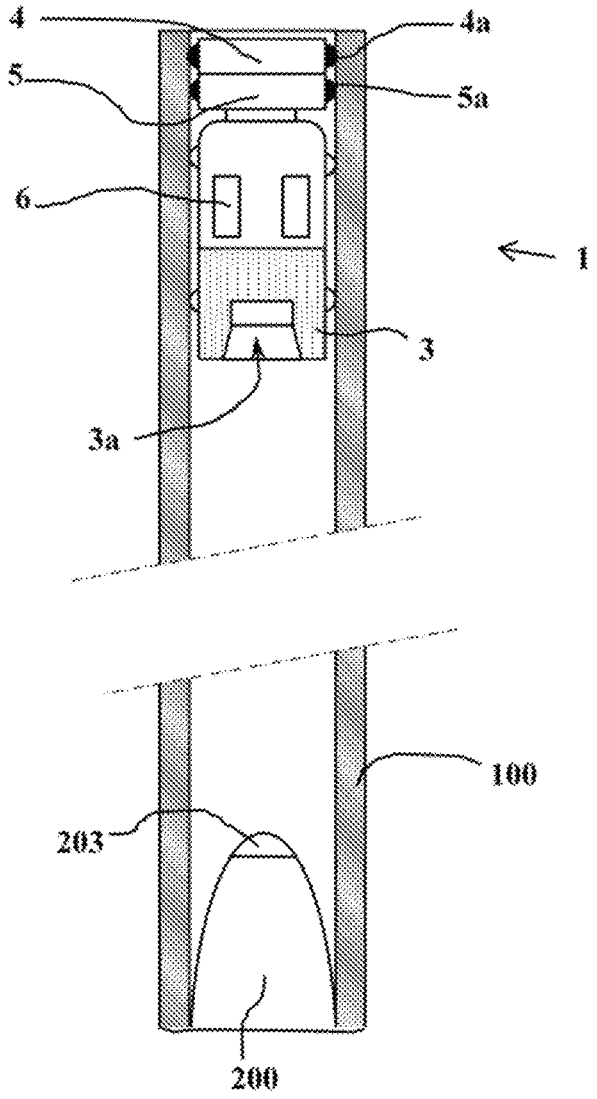

[Fig. 3]
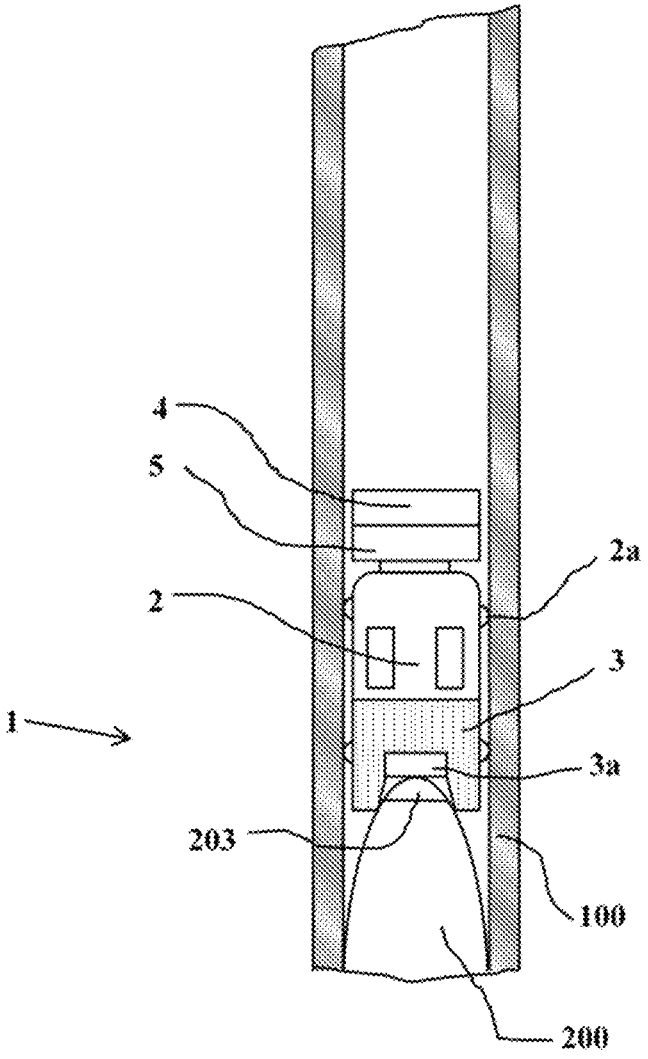

[Fig. 4]
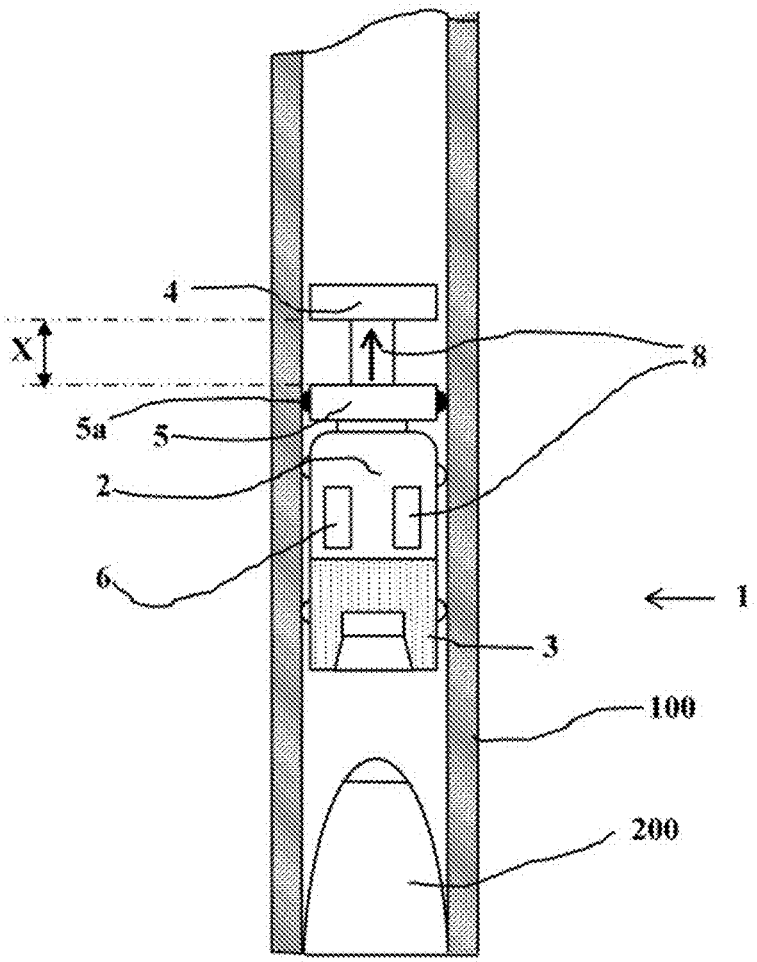

[Fig. 5]
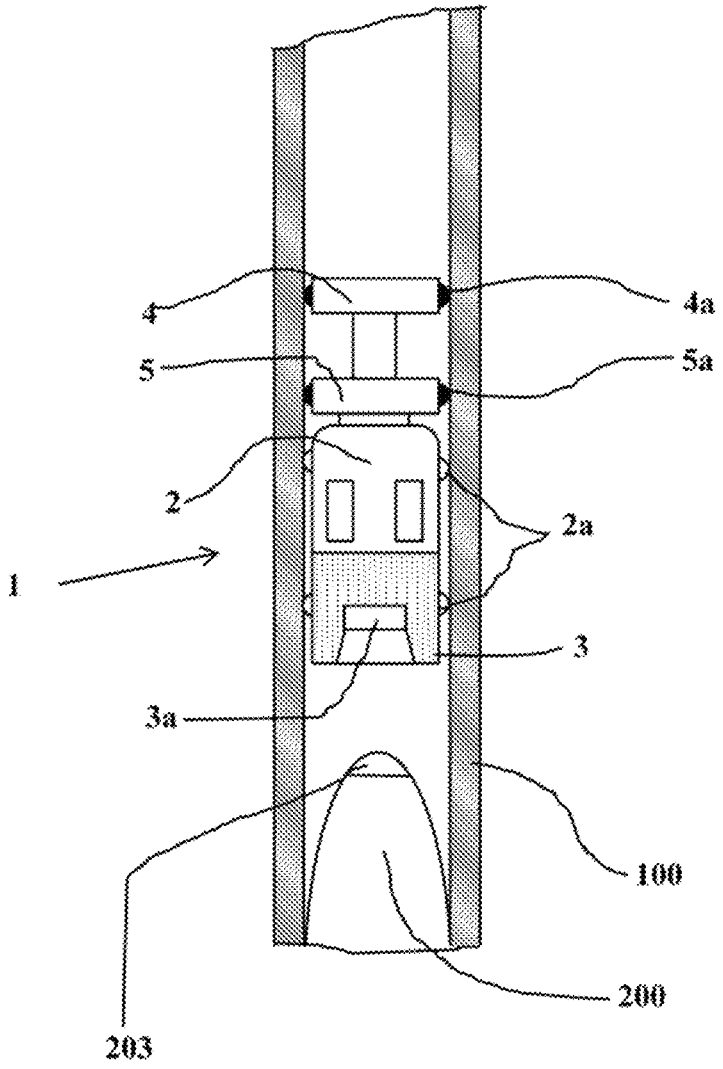

[Fig. 6]
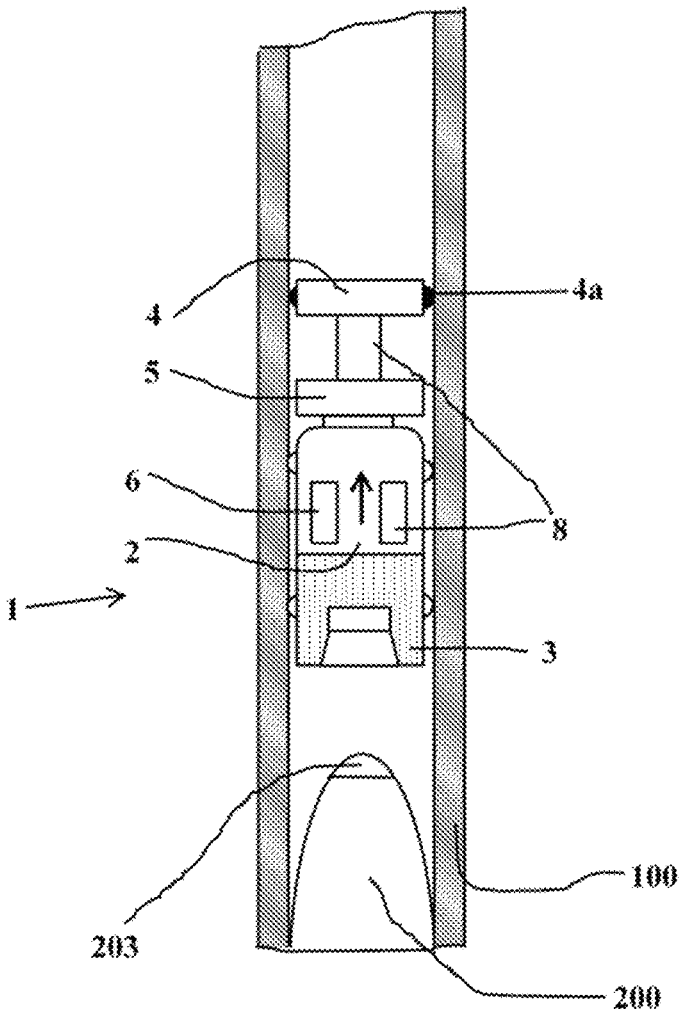

[Fig. 7]
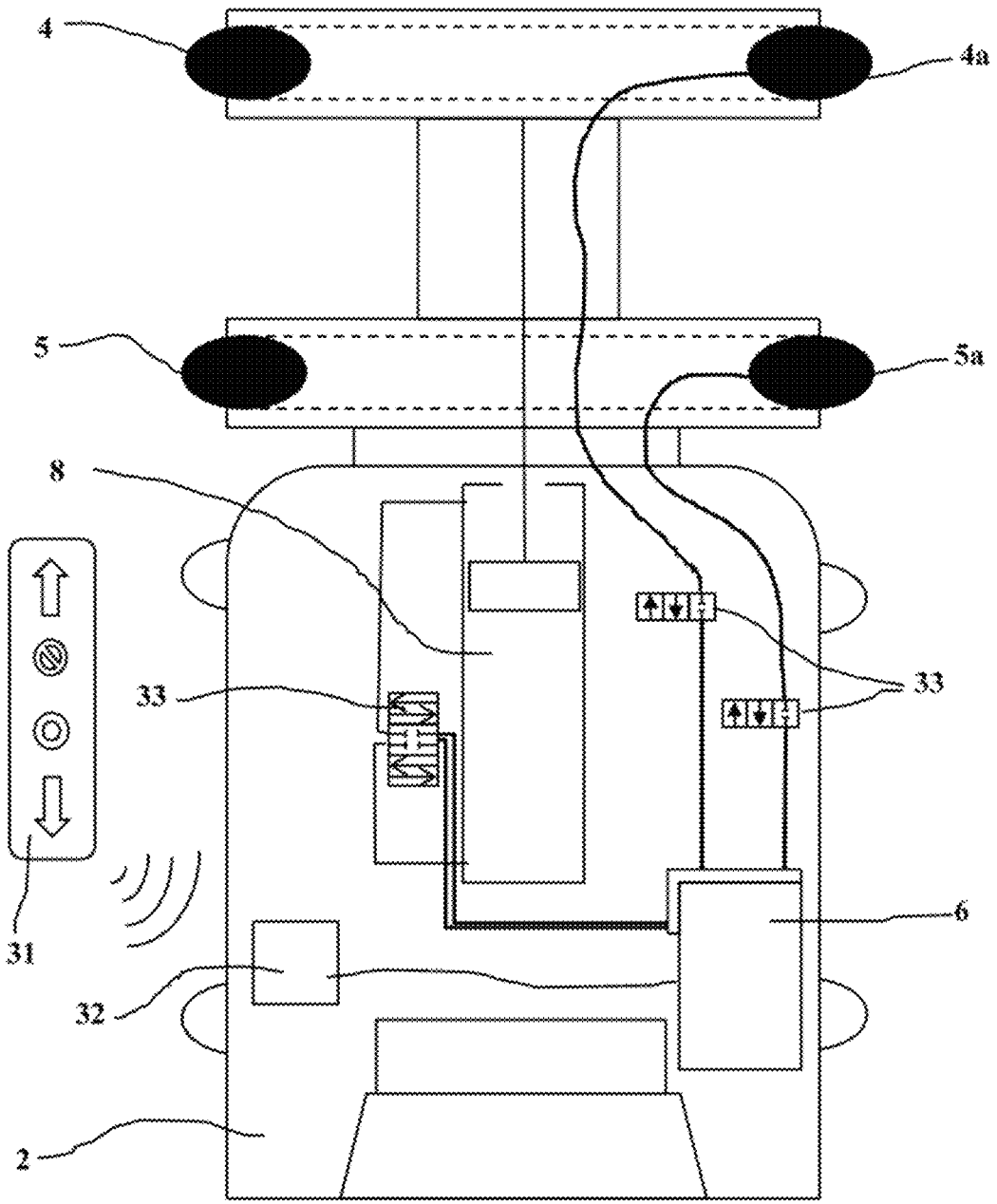

[Fig. 8a]
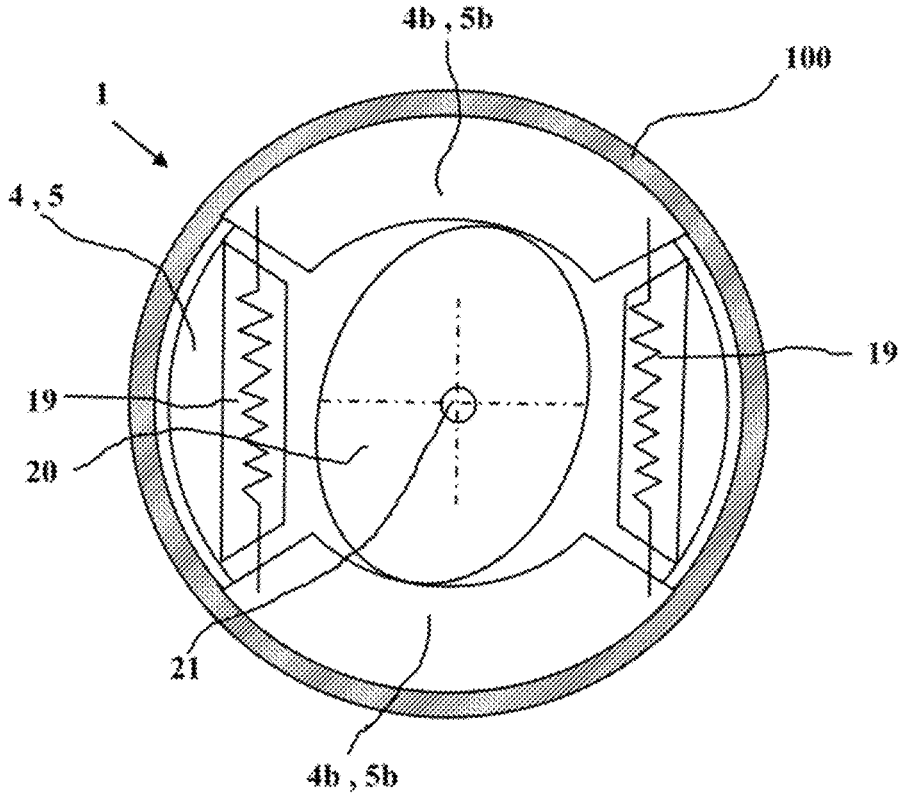

[Fig. 8b]

[Fig. 9a]
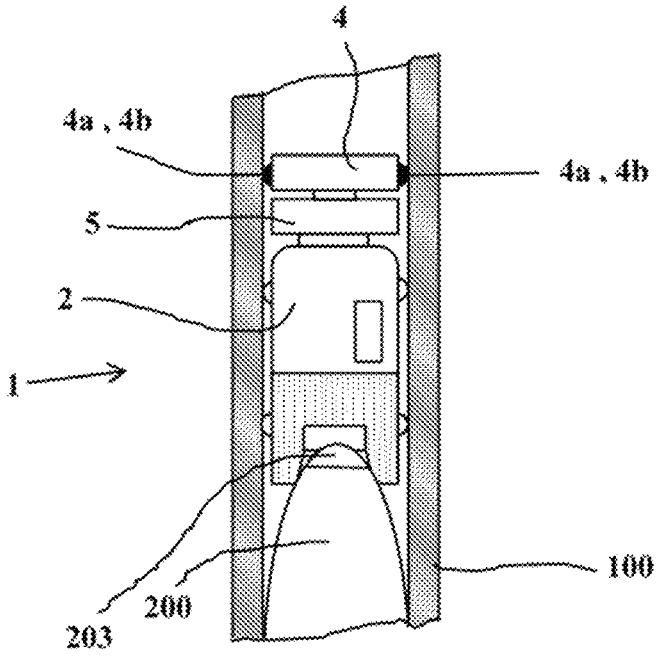

[Fig. 9b]
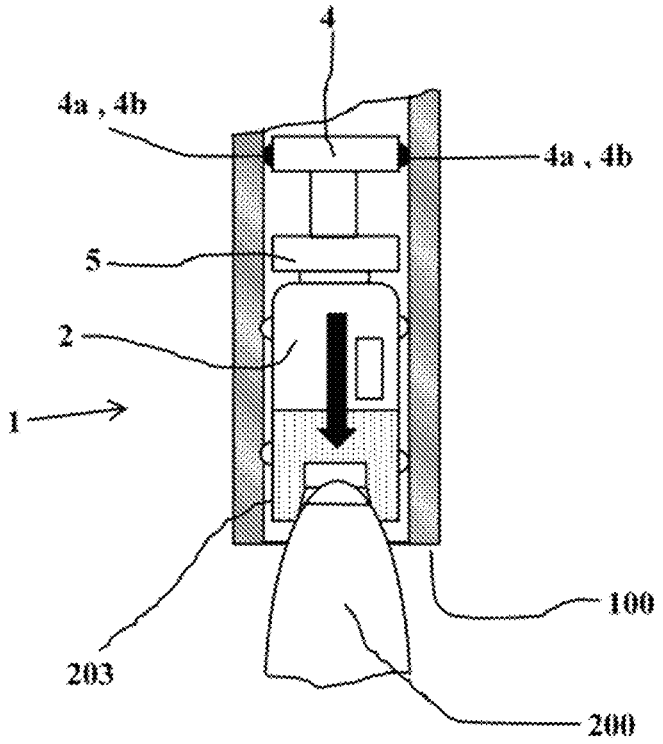

DEVICE FOR EXTRACTING A LARGE-CALIBER PROJECTILE JAMMED IN A WEAPON BARREL

The technical field of the invention is that of devices and methods for extracting a large-caliber projectile jammed in a weapon barrel.

When a large-caliber projectile is rammed in a weapon barrel, the projectile is held in place by its jamming in the forcing cone of the barrel.

It may happen that a malfunction of the artillery piece or a cancellation of the firing order generates the need to remove the projectile from the barrel to make the weapon safe.

To enable the projectile to be unjammed and removed, patent FR2975178 teaches the use of an extraction device comprising an unjamming mass with a diameter smaller than the caliber of the barrel, said mass being intended to be introduced into the barrel at the muzzle of the latter, and then to be released into the barrel to impact by inertia the jammed projectile.

The mass is secured to one end of a rope and, in order to be able to lock or release the rope, the second end of the latter can be secured to a locking and releasing means.

The locking and releasing means is secured to a vehicle carrying the weapon. Once the mass is inserted into the barrel, which must first be placed horizontally, the barrel must be raised to the highest possible elevation before proceeding with the remote dropping of the mass using the means for locking/releasing the cord.

During the entire barrel raising operation, the rope must be held taut manually, which poses safety concerns.

In addition, it is not always possible to attach the locking/releasing device of the weapon to a piece of artillery without interfering with other equipment on the piece.

Finally, if the projectile has not been released during the first dropping, it is necessary to repeat the entire operation of hoisting the mass, which implies the presence of an operator at the foot of the unsecured piece.

The invention proposes to simplify these unjamming devices and methods while solving this safety problem.

Thus, the invention relates to a device for extracting a large-caliber projectile jammed in a barrel of a weapon, the device comprising a solid body having a diameter smaller than the caliber of the barrel and intended to be introduced into the barrel at the muzzle of the latter and then to be released in the barrel in order to impact by inertia the jammed projectile, the device being characterized in that it comprises at least two radially expandable locking means, each able to move between a locked position in which it is applied radially against the inner wall of the barrel and a released position in which it is not applied against the barrel, the passage of the locking means from one position to the other being provided by an expansion means, the device comprising a translation means enabling a first locking means to be translated axially with respect to a second locking means.

According to a first embodiment, each locking means may comprise a toroidal chamber made of elastic plastic material, the expansion means comprising a pneumatic compressor coupled to the chambers by means of pneumatic valves which can be controlled so as to inflate one and/or the other of the chambers so that it/they wedge(s) radially in the barrel in the locked position, the deflation of one and/or the other chamber putting it/them the released position.

According to a second embodiment, each locking means may comprise at least one pair of jaws intended to cooperate with the inner surface of the barrel, wherein the jaws can be applied against the inside of the barrel by the expansion means.

According to a variant, the expansion means may comprise at least one elliptical roller driven in rotation by an electric motor, the roller pushing radially and simultaneously the two jaws of each pair, wherein elastic means connect the jaws of each pair against the action of the roller so as to bias the jaws towards the released position.

Alternatively, the device may include a detection means for detecting the arrival of the device at the muzzle of the weapon and which automatically interrupts the advance of the device.

The detection means may comprise an optical sensor.

The invention also relates to a method for extracting a large-caliber projectile jammed in a barrel of a weapon, the method being characterized in that an extraction device according to one of the preceding characteristics is used and by implementing the following steps:

- inserting the extraction device into the muzzle of the barrel;
- controlling at least one locking means so as to put it in the locked position;
- orienting the barrel at the maximum elevation;
- controlling all the locking means so as to put them in the released position, thereby freeing the device which then falls by gravity onto the projectile.

According to a particular embodiment, the method may comprise the following steps:

- after impact on the projectile, controlling a first locking means so that it translates axially relative to a second locking means;
- controlling the first locking means so as to put it in the locked position;
- controlling the second locking means secured to the body of the device so that it translates and is brought closer to the first locking means;
- controlling the second locking means so as to put it in the locked position;
- reiterating the operations of moving apart and then locking and of bringing together and then locking the locking means until the device reaches the muzzle of the barrel;
- controlling all the locking means so as to put them in the released position, thereby freeing the device which then falls by gravity onto the projectile.

According to a variant, the following steps can be performed after impact on the projectile:

- bringing together the two locking means previously placed in the released position;
- controlling the first locking means so as to put it in the locked position;
- controlling the second locking means secured to the body of the device so that it translates and moves away from the first locking means so as to exert a pressure on the projectile.

The invention will be better understood on reading the following description, a description made with reference to the appended drawings, in which drawings:

FIG. 1 represents a schematic view in longitudinal section of a device according to the invention in a weapon barrel during a first phase of use.

FIG. 2 represents a schematic view in longitudinal section of a device according to the invention in a weapon barrel during a second phase of use.

FIG. 3 represents a schematic longitudinal sectional view of a device according to the invention in a weapon barrel during a third phase of use.

FIG. 4 represents a schematic view in longitudinal section of a device according to the invention in a weapon barrel during a fourth phase of use.

FIG. 5 represents a schematic view in longitudinal section of a device according to the invention in a weapon barrel during a fifth phase of use.

FIG. 6 represents a schematic view in longitudinal section of a device according to the invention in a weapon barrel during a sixth phase of use.

FIG. 7 represents a schematic view in longitudinal section of a device according to the invention.

Figure 8B:
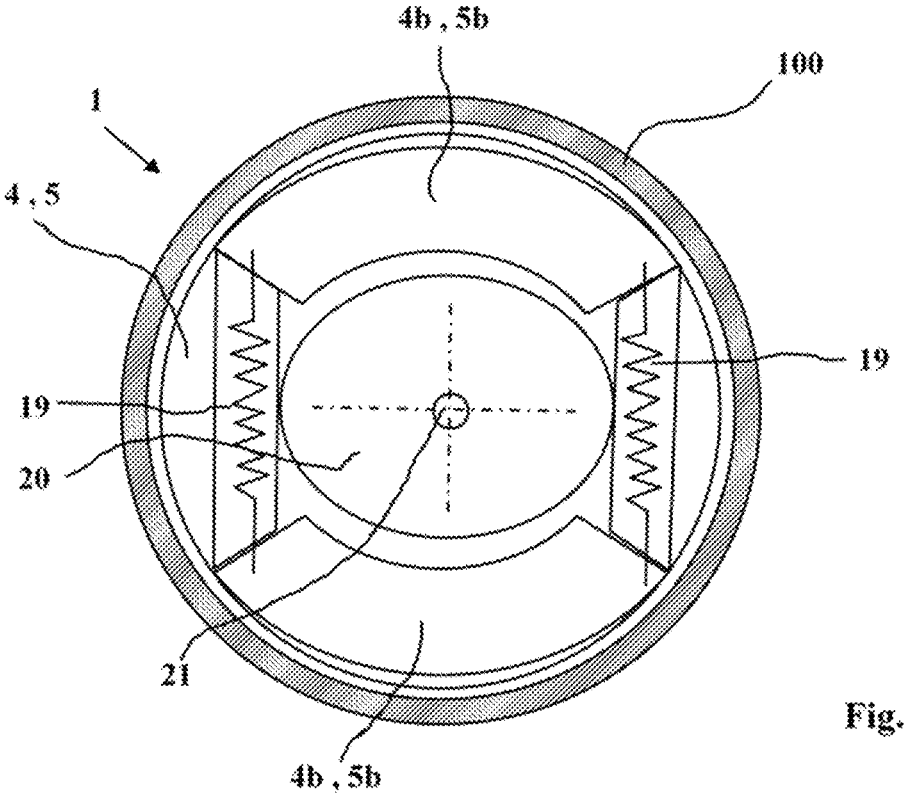

FIG. 8*a* represents a schematic view in transversal section of a device in a weapon barrel according to a second embodiment of the invention, the device being in a locked state.

FIG. 8*b* represents a schematic view in transversal section of a device in a weapon barrel according to a second embodiment of the invention, the device in a released state.

FIG. 9*a* represents a schematic view in longitudinal sectional of a device according to the invention in a weapon barrel in a first step of an alternative use.

FIG. 9*b* represents a schematic view in longitudinal sectional of a device according to the invention in a weapon barrel in a second step of an alternative use.

According to FIG. 1, an extraction device 1 according to the invention is introduced at the muzzle 101 of a weapon barrel 100 (in this case an artillery piece), previously oriented at zero elevation, in which a projectile 200 is jammed at the forcing cone.

The device 1 comprises a solid body 2, whose total mass is between 20 and 100 kilograms, and which comprises a knocking mass 3 (for example made of steel) on its face facing the projectile 200 to be unjammed. The body 2 has a smaller diameter than the barrel 100 in order to be able to slide in the barrel 100. In order to be able to slide better, the body may be equipped with skids 2*a* limiting the friction between the body 2 and the barrel 100.

The device 1 comprises at least two radially expandable locking means 4 and 5, each able to move between a locked position in which it is applied radially against the inner wall of the tube 100 and a released position in which it is not applied against the barrel 100. The passage of the locking means 4 and 5 from one of the positions to the other of the positions is provided by an expansion means 6.

Various embodiments of the radially expandable locking means are possible. For example, for each locking means 4 and 5, at least two diametrically opposed jaws or sectors can be provided, which are radially displaced to come into contact or not with the wall of the barrel.

According to a particular embodiment schematized in FIGS. 2 to 7, each locking means 4 and 5 here comprises a toroidal chamber 4*a* and 5*a* made of an elastic plastic material or an elastomer. The expansion means 6 then comprises a pneumatic compressor 6 which is coupled to each of the chambers 4*a* or 5*a* by means of controllable pneumatic valves 33 (FIG. 7) which can be controlled so as to inflate one or other of the chambers so that it expands and comes to wedge radially against the wall of the barrel 100 to adopt a locked position. The valves 33 can then be controlled to deflate the chamber or chambers in question so that it or they no longer adhere to the barrel 100. The deflated chamber then occupies a released position. The chambers 4*a* and 5*a* will be better seen in the following figures.

According to FIG. 7, the body 2 of the device thus contains a pneumatic compressor 6 which is connected to each locking means 4 and 5 by pipes carrying controllable pneumatic valves 33. It also contains a translation means 8 which will comprise, for example, a linear pneumatic cylinder 8 the rod movement direction of which is controlled by one of the valves 33 (alternatively, a screw jack could be provided). The translation means 8 makes it possible for the locking means 4 and 5 to be moved axially towards or away from each other. An electronic control box 31 makes it possible to control the sequence of the inflation or deflation operations of the toroidal chambers 4*a* and 5*a* of each locking means 4 or 5 and the movement of the translation means 8. This control box 31 (or the body 2) may include a computer 32 or a programmable logic controller incorporating the control sequence(s) that will be described later.

Thus, in FIG. 2, the first locking means 4 and the second locking means 5 are both in locked position to ensure a perfect immobility of the device 1 with respect to the barrel 100. The device 1 has been previously introduced into the barrel 100, positioned horizontally. For the introduction, the locking means 4 and 5 are of course in the released position. Only after the device has been inserted are the locking means brought into the locked position by the expansion means 6, before the angle of elevation of the barrel is changed.

The power supply of the device 1 can be done either from an external source thanks to a power cord not shown or from batteries embedded in the device 1 (batteries not shown).

According to FIG. 2, the barrel 100 has been oriented at its maximum elevation, placing the device 1 in an almost vertical position.

In FIG. 3, it can be seen that the locking means 4 and 5 have been put in released position, causing by gravity the fall of the device 1 in the barrel 100. At the end of its fall represented in FIG. 3, the device 1 has hit the projectile 200 in the vicinity of its warhead, avoiding hitting the fuse 203 thanks to a clearance 3*a* arranged at the mass 3. The kinetic energy released by the impact of the device 1 on the projectile 200 should unjam the latter from the barrel 100. If the projectile 200 is not unjammed, the device 1 should be raised as high as possible in the barrel 100 to repeat the fall of the device 1 and cause a new impact on the projectile 200 to unjam it.

In accordance with the invention and as shown in FIG. 4, in order to carry out the ascent of the device 1 in the barrel 100, the second locking means 5 is first positioned in the locked position (here by inflating the chamber 5*a*). Then the first locking means 4, which is in a released position, is translated by a stroke X according to an axis parallel to the barrel 100 towards the muzzle of the barrel 100 using the translation means 8 which may comprise the pneumatic or screw-type linear actuator. This first translation movement tends to move the first locking means 4 away from the second locking means 5 and also from the body 2 of the device (which is axially fixed with respect to the second locking means).

At the end of the stroke X of the first locking means 4, the latter is put in a locked position as shown in FIG. 5, here by inflating the chamber 4*a*.

Then, as shown in FIG. 6, the second locking means 5 is moved to the released position. The translation means 8 is then actuated in the opposite direction so as to bring the locking means 4 and 5 closer to each other. This movement causes the body 2 of the device 1 to move upwards in the barrel 100 and more generally causes the whole device 1 to move upwards by a distance X towards the top of the barrel 100.

At the end of the stroke X of the device body 2 towards the first locking means 4, the second locking means 5 is put in locked position, ensuring the immobilization of the device 1 with respect to the barrel 100, and placing the device in a configuration identical to that of FIG. 2. It is then possible to reiterate the displacement and then locking of the first locking means 4 with respect to the second locking means 5 as previously described.

By reiterating these displacement and locking operations, a step-by-step movement of stroke X at each step is obtained which makes it possible for the device 1 to reach the top of the barrel 100 without an operator having to approach the artillery piece.

The upward movement of the device 1 is interrupted when the device 1 has arrived at the weapon muzzle. This interruption can either be controlled by a remote operator or occur automatically.

The detection of the reaching of the muzzle 101 of the barrel 100 could be done for example by means of a sensor evaluating the distance covered by the device 1 in the barrel (by counting for example the number of stroke X cycles).

It is also possible to provide a detector secured to an upper face of the locking means 4 and enabling an optical detection of the light in its radial field of observation (indication that the detector has left the barrel).

Once the device has returned to the level of the muzzle 101 of the weapon barrel, a new release can be carried out by the command of an operator, or the device can be withdrawn if it is not necessary to make it fall on the projectile once again. The device can also be removed through the breech once the projectile is released.

According to another embodiment shown in FIGS. 8*a* and 8*b*, each locking means 4 and 5 no longer comprises toroidal chambers 4*a* and 5*a* but at least one pair of jaws 4*b* (or 5*b*), diametrically opposed and which each have an external sector profile that corresponds with the inner surface of the barrel 100. Each locking means 4 and 5 comprises at least one elliptical roller 20 which, when pivoted, simultaneously pushes the two jaws 4*b* (or 5*b*) associated therewith radially against the inside of the barrel 100 so as to lock the locking means 4 or 5 in the barrel 100 as seen in FIG. 8*a*.

Elastic means 19 (here a pair of springs connecting the ends of the jaws) connect the jaws of each pair and act against the action of the thrust of the roller or rollers 20. They allow the pairs of jaws 4*b* or 5*b* to be returned to the released position. The material of the jaws 4*b* and 5*b* will be chosen so that it offers the highest possible coefficient of friction in relation to the nature of the material of the inside of the barrel 100. The pivoting of each elliptical roller 20 is provided by an electric motor 21.

The operation of this embodiment is analogous to that previously described with reference to FIGS. 1 through 6. The pairs of jaws 4*b* and 5*b* replace the toroidal chambers 4*a* and 5*a* to form the radially expandable locking means 4 and 5.

According to a variant of the operating mode, which is represented in FIGS. 9*a* and 9*b*, when the device 1 has hit the projectile 200 and if the unjamming could not be obtained, it will be possible to check that the two locking means 4 and 5 are as close as possible to each other and then command the locking of the first locking means 4.

Then, instead of raising the device to make a new fall, the two locking means 4 and 5 are moved away from each other.

This causes the body 2 of the device 1 to push on the projectile 200, which may be sufficient in some cases to unjam it.

If the unjamming by pushing fails, the device 1 can be ordered to ascend towards the muzzle of the barrel to command a new dropping and fall by gravity of the device onto the projectile.

The invention thus provides a safe removal of a projectile jammed in a barrel since all the unjamming operations and the repetition of these operations can be controlled at a distance from the weapon (here the artillery piece).

The invention claimed is:

1. An extraction device for extracting a large-caliber projectile jammed in a barrel of a weapon, the extraction device comprising:

a solid body, the solid body having a diameter smaller than a caliber of a barrel and the solid body being configured to be introduced into the barrel at a muzzle of the barrel and is configured to then be released in the barrel in order to impact by inertia the projectile jammed in the barrel, at least two radially expandable locking locks, each of the plurality of locks being configured to move between a locked position in which one or more of the plurality of locks are applied radially against an inner wall of the barrel and a released position in which one or more of the plurality of locks are not applied against the barrel, an expansion means configured to move each of the plurality of locks between the locked position and the released position, and a cylinder configured to axially translate a first lock of the plurality of locks with respect to a second lock of the plurality of locks.

2. The extraction device according to claim 1, wherein:

each of the plurality of locks includes a toroidal chamber made of elastic plastic material, the expansion means includes a pneumatic compressor coupled to each of the toroidal chambers via pneumatic valves, and the pneumatic valves are configured to be controlled to inflate each of the toroidal chambers independently such that an inflation of any one of the toroidal chambers radially wedges the respective toroidal chamber in the barrel in the locked position and a deflation of any one of the toroidal chambers changes the respective toroidal chamber to the released position.

3. The extraction device according to claim 1, wherein:

each of the plurality of locks includes at least one pair of jaws configured to cooperate with an inner wall of the barrel, and each of the jaws are configured to be applied against the inner wall of the barrel by the expansion means.

4. The extraction device according to claim 3, wherein:

the expansion means includes at least one elliptical roller configured to be rotated by an electric motor, the at least one elliptical roller being configured to simultaneously push the two jaws of each of the at least one pair of jaws of a respective lock of the plurality of locks radially outward, and elastic means connect the two jaws of each of the at least one pair of jaws against an action of the elliptical roller to bias the two jaws towards the released position.

5. The extraction device according to claim 1, further comprising a detection means for detecting the arrival of the extraction device at the muzzle of the barrel, the detection means being configured to automatically interrupt an advance of the extraction device when arrival of the extraction device at the muzzle of the barrel is detected.

6. The extraction device according to claim 5, wherein the detection means includes an optical sensor.

7. A method for extracting a large-caliber projectile jammed in a barrel of a weapon, the extraction device according to claim 1 being used by implementing the following steps:

(i) inserting the extraction device into the muzzle of the barrel;

(ii) controlling at least one of the plurality of locks to put the at least one of the plurality of locks in the locked position;

(iii) orienting the barrel at a maximum elevation; and (iv) controlling the plurality of locks to put the plurality of locks in the released position such that the extraction device is free to then fall by gravity onto the projectile.

8. The method for extracting a projectile according to claim 7, further comprising the following steps after the extraction device has impacted the projectile:

(v) controlling the first lock of the plurality of locks such that the first lock of the plurality of locks translates axially relative to the second lock of the plurality of locks;

(vi) controlling the first lock of the plurality of locks to put the first lock of the plurality of locks in the locked position;

(vii) controlling the second lock of the plurality of locks, the second lock of the plurality of locks being secured to the solid body of the extraction device, such that the second lock translates and is brought closer to the first lock;

(viii) controlling the second lock of the plurality of locks to put the second lock of the plurality of locks in the locked position;

(ix) reiterating steps (v)-(viii) until the extraction device reaches the muzzle of the barrel;

(x) controlling all the plurality of locks to put all the plurality of locks in the released position such that the extraction device is free to fall by gravity onto the projectile.

9. The method for extracting a projectile according to claim 7, further comprising the following steps after the extraction device has impacted the projectile:

(v) bringing together the first lock and the second lock of the plurality of locks while placed in the released position;

(vi) controlling the first lock of the plurality of locks to put the first lock of the plurality of locks in the locked position; and (vii) controlling the second lock of the plurality of locks, the second lock of the plurality of locks being secured to the solid body of the extraction device, such that the second lock of the plurality of locks translates and moves away from the first lock of the plurality of locks to exert a pressure on the projectile.

* * * * *